US010293901B1

(12) United States Patent
Sitton

(10) Patent No.: US 10,293,901 B1
(45) Date of Patent: May 21, 2019

(54) BOAT FENDER SYSTEMS

(71) Applicant: Jeffrey David Sitton, Liberty Lake, WA (US)

(72) Inventor: Jeffrey David Sitton, Liberty Lake, WA (US)

( * ) Notice: Subject to any disclaimer, the term of this patent is extended or adjusted under 35 U.S.C. 154(b) by 0 days.

(21) Appl. No.: 15/848,499

(22) Filed: Dec. 20, 2017

(51) Int. Cl.
*B63B 59/02* (2006.01)

(52) U.S. Cl.
CPC ..... *B63B 59/02* (2013.01); *B63B 2059/025* (2013.01)

(58) Field of Classification Search
CPC ..... B63B 59/00; B63B 59/02; B63B 2059/00; B63B 2059/02; B63B 2059/025
USPC ..... 114/219
See application file for complete search history.

(56) References Cited

U.S. PATENT DOCUMENTS 5,706,751 A * 1/1998 Hodges ..... B63B 1/32 114/219
5,743,203 A * 4/1998 NcNamara ..... B63B 3/04 114/219
6,148,754 A * 11/2000 Sims, Jr. ..... B63B 59/02 114/219
2007/0137545 A1* 6/2007 Hynes ..... B63B 59/02 114/219
2011/0247542 A1* 10/2011 Jones ..... B63B 1/04 114/283
2015/0114274 A1* 4/2015 de Bruijn ..... E02B 3/26 114/219

* cited by examiner

*Primary Examiner* — Daniel V Venne
(74) *Attorney, Agent, or Firm* — Lee & Hayes, P.C.

(57) ABSTRACT

A boat fender system comprising a boat fender including a first portion that absorbs kinetic energy to prevent damaging a surface of a boat. The first portion having a first surface facing out away from the surface of the boat. The boat fender including a second portion arranged with the first portion. The second portion having a second surface facing toward the surface of the boat. The boat fender including an adhesive arranged on the second surface of the second portion of the boat fender. The adhesive arranged on the second surface of the second portion of the boat fender adherable to the surface of the boat to make the boat fender immobile on the surface of the boat.

12 Claims, 7 Drawing Sheets

BOAT FENDER SYSTEMS

BACKGROUND

Boat fenders or bumpers exist for preventing damage from occurring to boats. For boats smaller than cargo ships, cruise ships, ferries, etc. the boat fenders are typically moveable. For example, in the recreational boat industry, moveable boat fenders are employed that are positioned outside of a boat and between a dock, or another boat. Boat enthusiast may use a variety of moveable boat fenders to protect their boats, however all of the moveable boat fenders have the disadvantage of being detachable from the boats. Because the moveable boat fenders are detachable from the boats, the moveable boat fenders may become dislodged from a boat and expose the boat to damage caused by contact with a dock, for example. Moreover, because the moveable boat fenders are detachable from the boats, the moveable boat fenders may be inappropriate stowed or lost (e.g., misplaced) and subsequently difficult to find when desired at a time of an event (e.g., docking, berthing, mooring, anchoring, etc.).

Accordingly, there remains a need in the art for a boat fender system that will not become lost or inappropriately stowed and is ready for use at a time of an event to prevent damage from occurring to boats.

SUMMARY

Boat fender systems are configured to prevent damage to a boat. Generally, the boat fender systems include a boat fender having a first portion that absorbs kinetic energy to prevent damage to a surface of a boat, and an adhesive arranged on a second portion. The adhesive is adherable to a surface of a boat to make the boat fender generally immobile on the surface of the boat. When the adhesive is adhered to the surface of the boat, the boat fender is immobilized (e.g., prevented from moving) on the surface of the boat in a position ready to prevent damage from occurring to the boat. This summary is provided to introduce simplified concepts of boat fender systems, which are further described below in the Detailed Description. This summary is not intended to identify essential features of the claimed subject matter, nor is it intended for use in determining the scope of the claimed subject matter.

In one example, a boat fender system includes a boat fender including a first portion for absorbing kinetic energy to prevent damage to a surface of a boat. The first portion of the example boat fender having an elongated shape with a length longer than a width and a first surface facing out away from a portion of a hull of the boat above a waterline of the boat. The boat fender includes a second portion that is arranged (e.g., formed, molded, fixed, fastened, secured, adhered, etc.) with the first portion, the second portion having a second surface facing toward the portion of the hull of the boat. The boat fender includes an adhesive that is arranged (e.g., fixed, fastened, secured, adhered, etc.) on the second surface of the second portion of the boat fender. The adhesive is adherable to the portion of the hull of the boat to immobilize the length of the elongated shape of the first portion vertically on the portion of the hull of the boat. For example, the adhesive is adherable to the portion of the hull of the boat to prevent the length of the elongated shape of the first portion from moving from a vertical position on the portion of the hull of the boat.

In another example, a boat fender system includes a boat fender including a first portion that absorbs kinetic energy to prevent damaging a surface of a boat, the first portion having a first surface facing out away from the surface of the boat. The boat fender includes a second portion that is arranged with the first portion, and the second portion has a second surface facing toward the surface of the boat. The boat fender includes an adhesive that is arranged on the second surface of the second portion. The adhesive is adherable to the surface of the boat to make the boat fender immobile on the surface of the boat.

In another example, a boat fender system includes a boat and a boat fender. The boat fender including a first portion that absorbs kinetic energy to prevent damage to a surface of the boat and the first portion having a first surface facing out away from the surface of the boat. The boat fender including a second portion arranged with the first portion and the second portion having a second surface facing toward the surface of the boat. The boat fender including an adhesive arranged on the second surface of the second portion. The adhesive is adhered to the surface of the boat to make the boat fender immobile on the surface of the boat.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
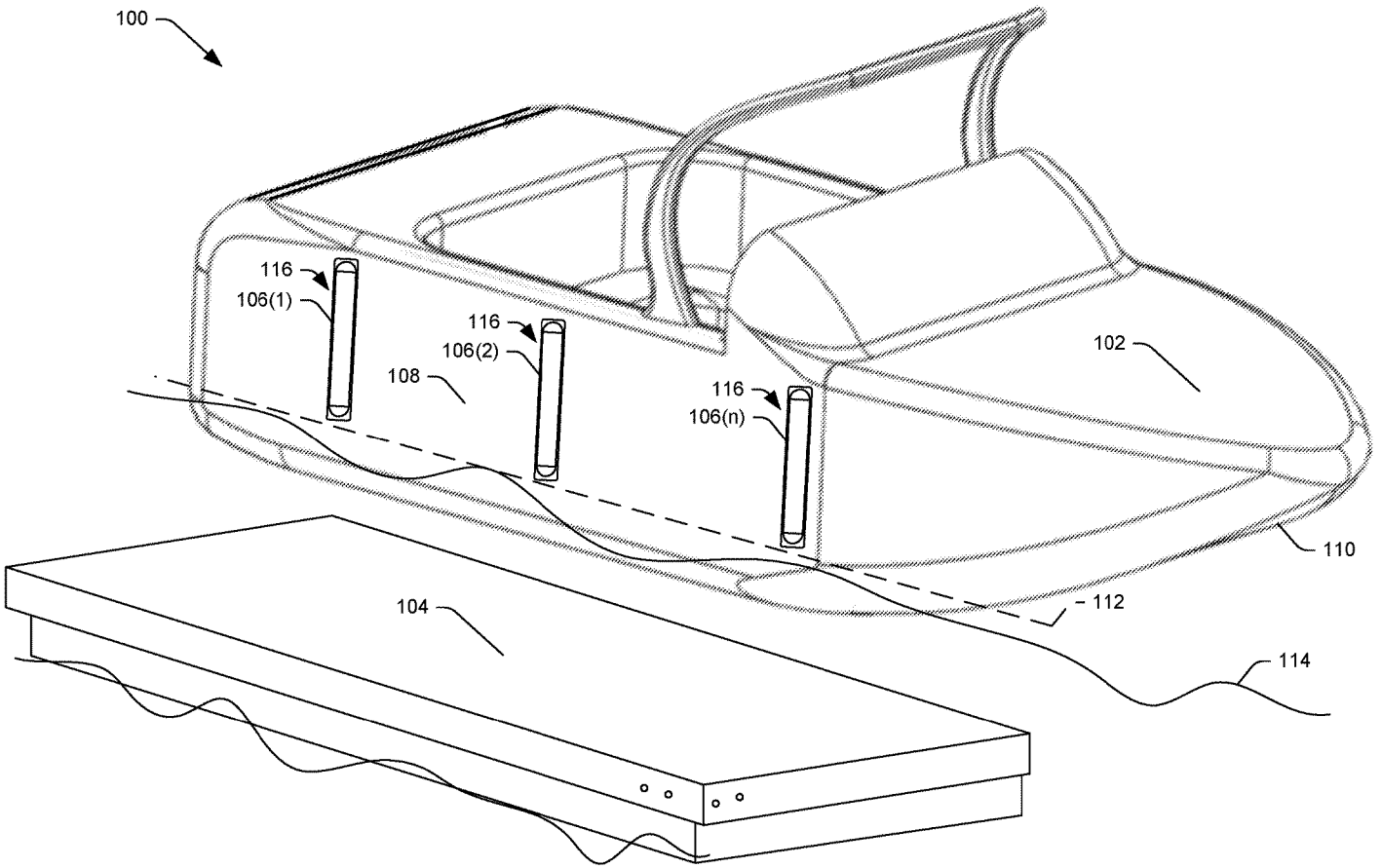
FIG. 1 illustrates an example boating environment of an example boat fender system.

This disclosure is directed to boat fender systems that adhere to a surface of a boat to prevent damage from occurring to the surface of the boat. For example, the boat fender systems may include a boat fender including an adhesive adherable to the surface of the boat to prevent the boat fender from moving on the surface of the boat to prevent damage from occurring to the surface of the boat. For example, the boat fender systems may include a boat fender including a first portion for absorbing kinetic energy to prevent damaging the boat, and the adhesive may be arranged on a second surface of a second portion of the boat fender that is adherable to the surface of the boat to prevent the boat fender from moving on the surface of the boat to prevent damage from occurring to the surface of the boat. Moreover, the first portion of the boat fender may have an elongated shape. The elongated shape having a length longer than a width and the adhesive may immobilize the length of the elongated shape vertically on the surface of the boat. In this way, the boat fender systems are immobilized on a surface of a boat in a position ready to prevent damage from occurring to the boat. For example, the adhesive is adherable to the portion of the hull of the boat to prevent the length of the elongated shape of the first portion from moving from a vertical position on the portion of the hull of the boat. While this application describes various embodiments of boat fender systems used in the field of recreational boating, this is by way of example and not limitation. For example, the boat fender systems may be used in other fields such as cargo ship applications, cruise ship applications, ferry applications, submarine applications, etc.

The boat fender systems may include a first portion for absorbing kinetic energy to prevent damage to a recreational boat. Damage to a recreational boat may range from surface blemishes to sutural compromises. A recreational boat as used herein comprises a boat having a length ranging from about 14 feet to about 35 feet. While this application describes recreational boats having a length ranging from about 14 feet to about 35 feet, the recreational boats may have smaller lengths or larger lengths. A recreational boat comprises cabin boats, deck boats, fishing boats, high performance boats, motor yachts, cruisers, jet boats, multi-hull power boats, personal watercrafts (e.g., Jet Ski), sportfishing boats, trawlers, walkarounds, ski boats, wake boats, surf boats, sailboats, pontoon boats, etc. In the example where the boat fender system includes a boat fender having an elongated shape having a length longer than a width, the boat fender may be secured, via an adhesive, vertically on a hull or pontoon of a recreational boat in a position ready to prevent damage from occurring to the recreational boat. For example, the adhesive may immobilize the elongated shaped boat fender vertically on a portion of the hull or pontoon of the recreational boat that is above a water line of the recreational boat to prevent damage from occurring to the recreational boat. Because the adhesive may permanently immobilize the boat fender to the portion of the hull or pontoon of the recreational boat, the boat fender may always be ready for use at a time of an event (e.g., docking, berthing, mooring, anchoring, etc.) to prevent damage from occurring to the recreational boat.

Illustrative Boat Fender Systems

FIG. 1 illustrates an example boating environment 100 involving a boat 102 and a dock 104. For example, FIG. 1 illustrates a boating environment 100 where the boat 102 is docking with the dock 104. Further, FIG. 1 illustrates boat fenders 106(1), 106(2), and **106(*n*) immobilized on a portion 108 of a hull 110 the boat 102 in a position ready to prevent damage from occurring to the boat 102 when docking with the dock 104. For example, an adhesive may provide for immobilizing the boat fenders 106(1)-106(*n*) on the portion 108 of the hull 110 of the boat 102 in the position ready to prevent damage from occurring to the boat 102. While FIG. 1 illustrates the boat fenders 106(1)-106(*n*) are immobilized on the portion 108 of the hull 110 of the boat 102 above a waterline 112 of the boat 102, at least a portion of one or more of the boat fenders 106(1)-106(*n*) may be immobilized on the hull 110 of the boat 102 below the waterline 112 of the boat 102. FIG. 1 illustrates the waterline 112 of the boat 102 is the line where the hull 110 of the boat meets the surface of the water 114**.

While FIG. 1 illustrates the boat 102 being a waterski boat, the boat 102 may be any type of recreational boat. For example, the boat 102 may be a cabin boat, a deck boat, a fishing boat, a high performance boat, a motor yacht, a cruiser, a jet boat, a multi-hull power boat, a personal watercraft (e.g., Jet Ski), a sportfishing boat, a trawler, a walkaround, a ski boat, a wake boat, a surf boat, a sailboat, a pontoon boat, etc. Further, while FIG. 1 illustrates a boating environment 100 where the boat fenders **106(1)-106(*n*) are in position to prevent damage from occurring between the boat 102 and the dock 104, other types of boating environments may occur. For example, a boating environment may occur where the boat 102 is fendering (e.g., bumpering) against another boat (e.g., boat to boat fendering), against a jetty, against a pier, against a wall, against a quay wall, etc. In most cases, the boat fenders 106(1)-106(*n*) are immobilized vertically on the portion 108 of the hull 110 the boat 102 and prevent damage from occurring to the boat 102 and/or the dock 104, by absorbing kinetic energy produced between the boat 102 and the dock 104**.

While FIG. 1 illustrates the boat fenders **106(1)-106(*n*) immobilized on a starboard side of the boat 102, one or more of the boat fenders 106(1)-106(*n*) may be immobilized on other parts of the boat 102. For example, one or more of the boat fenders 106(1)-106(*n*) may be immobilized on a port side of the boat 102, a bow of the boat 102, a stern of the boat, etc. Moreover, while FIG. 1 illustrates the boat fenders 106(1)-106(*n*) having an elongated shape 116 immobilized vertically on the portion 108 of the hull 110 of the boat 102, other shapes and/or orientations may occur. For example, each of the boat fenders 106(1)-106(*n*) may have a first portion having a first elongated shape and a second portion having a second elongated shape (discussed in more detail below), and/or one or more of the boat fenders 106(1)-106(*n*) may be immobilized horizontally or obliquely on the portion 108 of the hull 110 of the boat 102**.

FIG. 1 illustrates the boat 102 including three boat fenders **106(1)-106(*n*)**. However, in other environments, a boat may include more than three or few than three boat fenders. For instance, a number of boat fenders may be proportional to a length of boat (e.g., a longer boat may have more boat fenders). In some instance, a boat may include more boat fenders depending on the type of water typically navigated or a docking location of the boat. For instance, a boat that is typically docked in rough waters may have more boat fenders.

Figure 2:
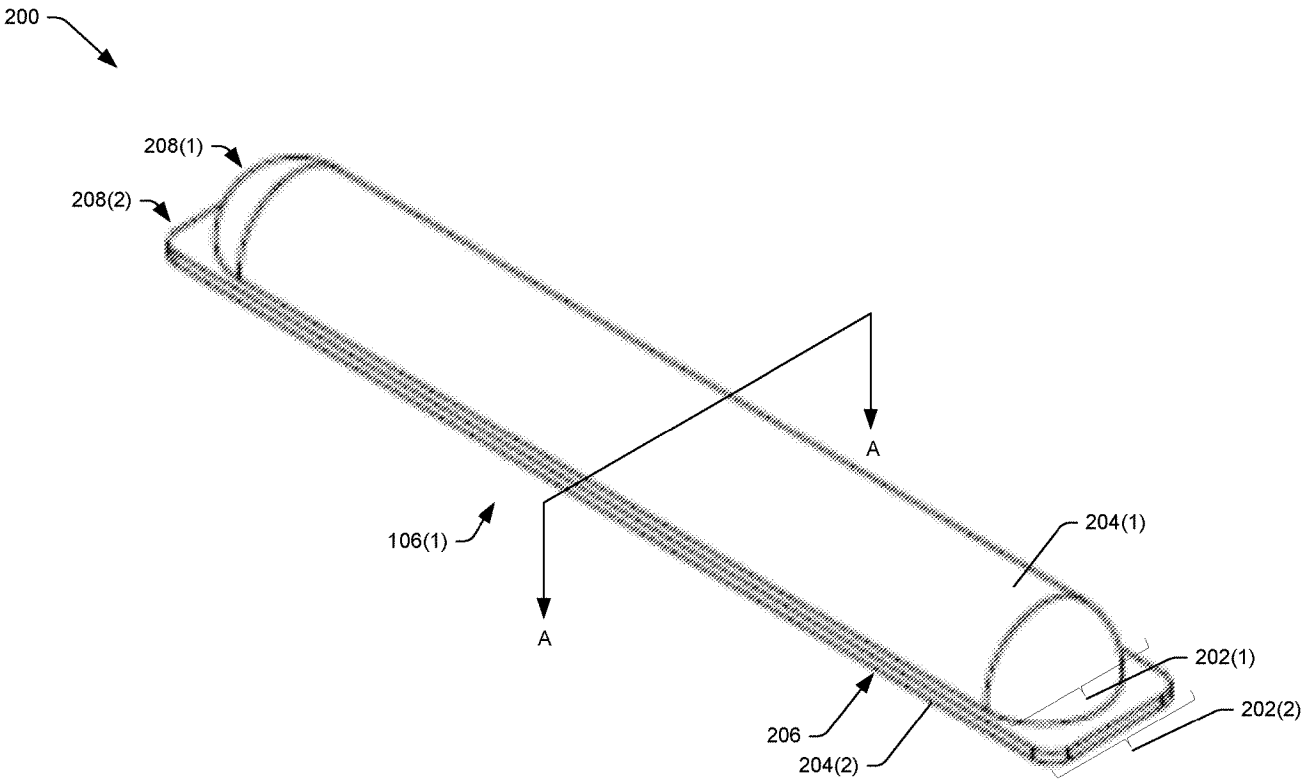
FIG. 2 illustrates a perspective view of an example boat fender shown in FIG. 1.

FIG. 2 illustrates a perspective view 200 of the boat fender 106(1) shown in FIG. 1. FIG. 2 illustrates the boat fender 106(1) in more detail, and shows the boat fender 106(1) having a first portion 202(1) that absorbs kinetic energy of an object to prevent the object from damaging a surface (e.g., a hull or a pontoon) of the boat 102. For example, the first portion 202(1) of the fender 106(1) may have a first surface 204(1) that faces out away from the hull 110 of the boat 102 that absorbs kinetic energy to prevent damaging the hull 110 of the boat 102.

FIG. 2 illustrates the boat fender 106(1) having a second portion 202(2) arranged with the first portion 202(1) of the boat fender 106(1). The second portion 202(2) having a second surface 204(2) that faces toward the hull 110 of the boat 102. An adhesive 206 may be arranged to substantially cover all or a portion of the second surface 204(2) of the second portion 202(2) of the boat fender 106(1). The adhesive 206 arranged on the second surface 204(2) may adhere to the hull 110 of the boat 102 to secure the boat fender 106(1) on the hull 110 of the boat 102. The adhesive 206 may be a layer of adhesive transfer tape arranged on the second surface 204(2) of the second portion 202(2) of the boat fender 106(1). For example, a layer of adhesive may be irremovably adhered to the second surface 204(2) of the second portion 202(2) of the boat fender 106(1) and a liner (e.g., paper liner, containerboard, plastic liner, etc.) may be removeably adhered to the layer of adhesive irremovably adhered to the second surface 204(2) of the second portion 202(2) of the boat fender 106(1). In one example, the layer of adhesive may be a tape fastener made with acrylic foam that provides for a permanent adhesion. In one example, a user may remove (e.g., peal) the liner off of the layer of adhesive irremovably adhered to the second surface 204(2) of the second portion 202(2) of the boat fender 106(1) and subsequently adhere the layer of adhesive to the hull 110 of the boat 102 to immobilize the boat fender 106(1) to the hull 110 of the boat 102. In another example, the layer of adhesive transfer tape may be a first layer of a two-part layer adhesive transfer tape, and a user may adhere a second layer of adhesive to the hull 110 of the boat 102, and subsequently adhere the first layer to the second layer to immobilize the boat fender 106(1) to the hull 110 of the boat 102. In another example, the adhesive 206 may be a layer of adhesive arranged on the second surface 204(2) of the second portion 202(2) of the boat fender 106(1) that fixes a gripping member to the second surface 204(2) of the second portion 202(2) of the boat fender 106(1). For example, the adhesive 206 may fix a first hook and loop member to the second surface 204(2) of the second portion 202(2) of the boat fender 106(1). The first hook and loop member fixed to the second surface of the second portion 202(2) of the boat fender 106(1) being arranged to bind with a second hook and loop member fixed to the hull 110 of the boat 102. While FIG. 2 illustrates an adhesive 206 arranged on the second surface 204(2) to adhere to the hull 110 of the boat 102 to provide for making the boat fender 106(1) immobile on the hull 110 of the boat 102, other fastening mechanism are possible. For example, one or more suction cup members may be arranged with the second surface 204(2) of the second portion 202(2) of the boat fender 106(1) that adhere to the hull 110 of the boat 102 to provide for making the boat fender 106(1) immobile on the hull 110 of the boat 102. In the example where one or more suction cup members are arranged with the second surface 204(2) of the second portion 202(2) of the boat fender 106(1), the one or more suction cup members may be formed integrally, as a single unit, with the second portion 202(2) of the boat fender 106(1). For example, the one or more suction cup members may be a material molded (e.g., injection molded, hollow injection molded, over-molded, multi-component injection molded, multi-shot injection molded, etc.) to the second surface 204(2) of the second portion 202(2) of the boat fender 106(1). In another example, the adhesive 206 may be a cyanoacrylate, an epoxy, a methacrylate, a hot-melt, a solvent cement, a urethane, etc. For example, the adhesive 206 may be a cyanoacrylate, an epoxy, a methacrylate, a hot-melt, a solvent cement, a urethane, etc. housed in a dispenser that a user may use to apply the adhesive to a surface of the boat fender and/or a surface of the boat to secure the boat fender on the surface of the boat.

FIG. 2 illustrates the first portion 202(1) having a first elongated shape 208(1) having a length longer than a width, and the second portion 202(2) having a second elongated shape 208(2) having a length longer than a width. FIG. 2 illustrates the first elongated shape 208(1) of the first portion 202(1) having a curvilinear shape (e.g., cylindrical shape, tubular shape, cone shape, etc.) and the second elongated shape having a polyhedral shape (e.g., cubic shape, a parallelepiped shape, rhombohedron shape, etc.). While FIG. 2 illustrates the first elongated shape 208(1) having a curvilinear shape, the first elongated shape 208(1) may be other shapes. For example, the first elongated shape 208(1) may be a polyhedral shape. Moreover, while FIG. 2 illustrates the second elongated shape 208(2) having a polyhedral shape, the second elongated shape 208(2) may be other shapes. For example, the second elongated shape 208(2) may have a curvilinear shape.

FIG. 2 illustrates the first elongated shape 208(1) is arranged in-line with the second elongated shape 208(2). For example, a longitudinal axis of the first elongated shape 208(1) may be arranged parallel and coplanar to a longitudinal axis of the second elongated shape 208(2). While FIG. 2 illustrates the first elongated shape 208(1) of the first portion 202(1) arranged in-line with the second elongated shape 208(2) of the second portion 202(2), other arrangements and/or shapes of the first portion 202(1) and the second portion 202(2) may occur. For example, the second portion 202(2) may have a non-elongated shape (e.g., a shape having a length about equal to a width), and the first portion 202(1) may have the first elongated shape 208(1) extending a distance from the second portion 202(2) having non-elongated shape. For example, the second portion 202(2) having the non-elongated shape may be adhered to the hull 110 of the boat 102 and the first portion 202(1) having the first elongated shape 208(1) may have a first end of the first elongated shape 208(1) fixed to the second portion 202(2) fixed to the hull 110 and a second end of the first elongated shape 208(1) arranged a distance away from the first end of the first elongated shape 208(1).

FIG. 2 illustrates a section line A-A taken through a middle of the boat fender 106(1). For example, FIG. 2 illustrates the section line A-A taken at a location about halfway along a length of the boat fender 106(1).

Figure 3:
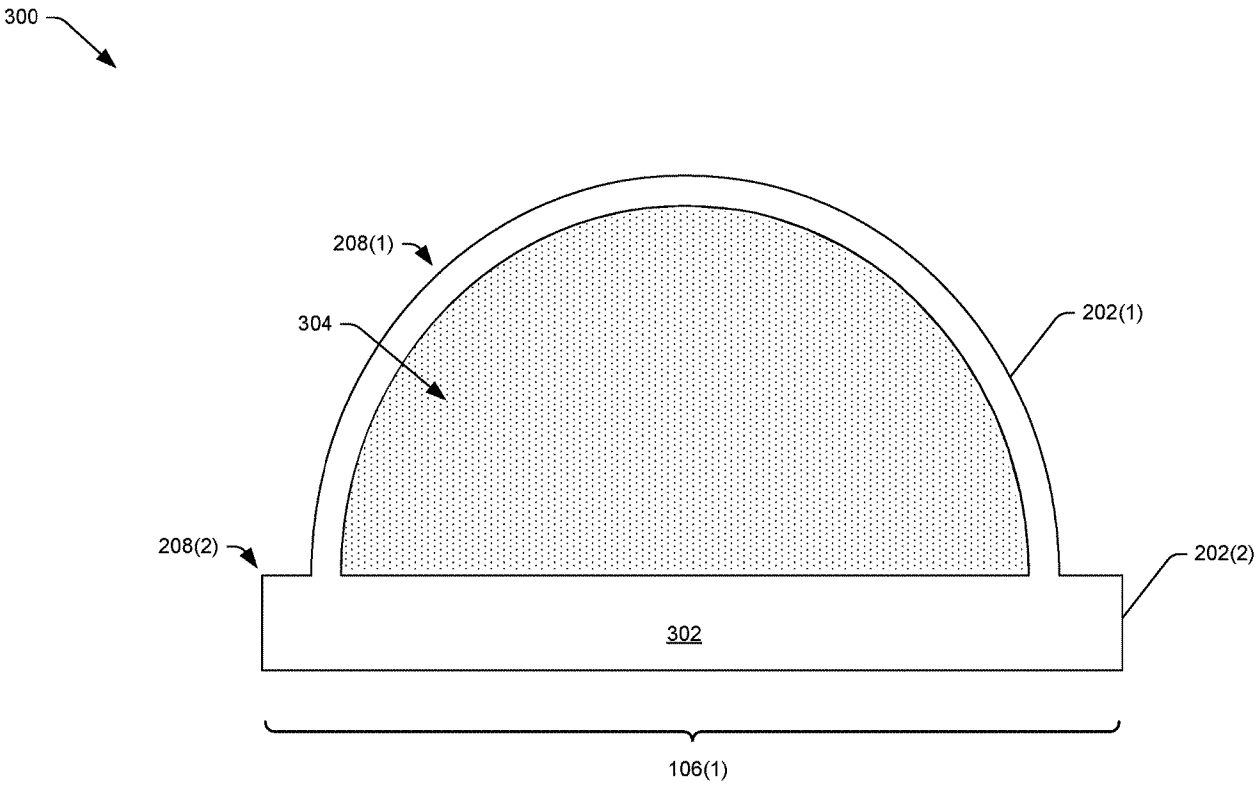
FIG. 3 illustrates an example section view of the example boat fender shown in FIG. 2.

FIG. 3 illustrates an example section view 300 of the boat fender 106(1) taken at about the section line A-A illustrated in FIG. 2. The example section view 300 illustrates the second portion 202(2) arranged with the first portion 202(1) forming a single unit 302. In one example, the single unit 303 may be formed of vinyl (e.g., marine vinyl), polyvinyl chloride (PVC), polyvinyl fluoride (PVF), polyvinyl acetate (PVA), synthetic rubber (e.g., ethylene propylene diene monomer (EPDM) rubber), latex, elastomer, or other UV resistant material, etc. The section view 300 illustrates the single unit 302 having a cavity 304 arranged in the first elongated shape 208(1) of the first portion 202(1) of the boat fender 106(1). The cavity 304 arranged in the first elongated shape 208(1) may retain a gaseous substance (e.g., air). The gaseous substance may provide for retaining a shape of the boat fender 106(1). The cavity 304 retaining the gaseous substance providing for absorbing kinetic energy to prevent damaging the hull 110 of the boat 102. While FIG. 3 illustrates a single cavity 304 arranged in the first elongated shape 208(1), multiple cavities may be arranged in the first elongated shape 208(1). For example, a plurality of cavities may extend a distance from the second surface 204(2) toward the first surface 204(1) (explained in more detail below with respect to FIG. 7). While FIG. 3 illustrates the second portion 202(2) arranged with the first portion 202(1) forming a single unit 302, the first portion 202(1) may be formed of a first material and the second portion 202(2) may be formed of a second material different from the first material. For example, the first portion 202(1) may be formed of first material that is molded (e.g., injection molded, hollow injection molded, over-molded, multi-component injection molded, multi-shot injection molded, etc.) to the second portion 202(2) formed of a second material different from the first material.

Figure 4:
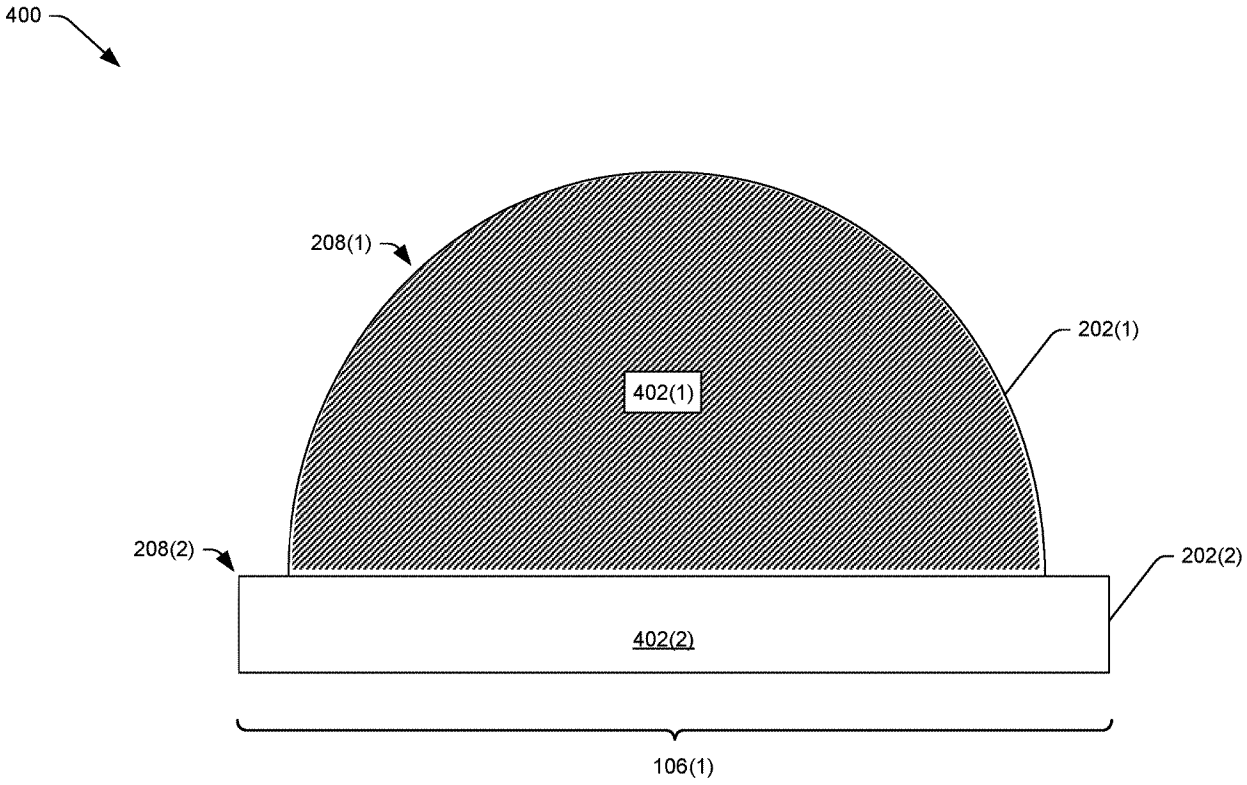
FIG. 4 illustrates another example section view of the example boat fender shown in FIG. 2.

FIG. 4 illustrates another example section view 400 of the boat fender 106(1) taken at about the section line A-A illustrated in FIG. 2. The example section view 400 illustrates the first elongated shape 208(1) of the first portion

202(1) is formed of a first material 402(1) and the second portion 202(2) is formed of a second material 402(2) different from the first material 402(1). For example, the first material 402(1) forming the first elongated shape 208(1) of the first portion 202(1) may be a semi-porous material (e.g., foam or neoprene) and the second material 402(2) forming the second portion 202(2) may be vinyl (e.g., marine vinyl), polyvinyl chloride (PVC), polyvinyl fluoride (PVF), polyvinyl acetate (PVA), synthetic rubber (e.g., ethylene propylene diene monomer (EPDM) rubber), latex, elastomer, etc. The semi-porous material may provide for retaining a shape of the boat fender 106(1). In the example where the first material 402(1) is a semi-porous material, the semi-porous material may be a substantially less abrasive material compared to the second material 402(2). For example, the semi-porous material may be more subtle or softer compared to the second material that substantially reduces erosion of a gel coat of a fiber-reinforced composite (e.g., fiberglass) of a boat.

Figure 5:
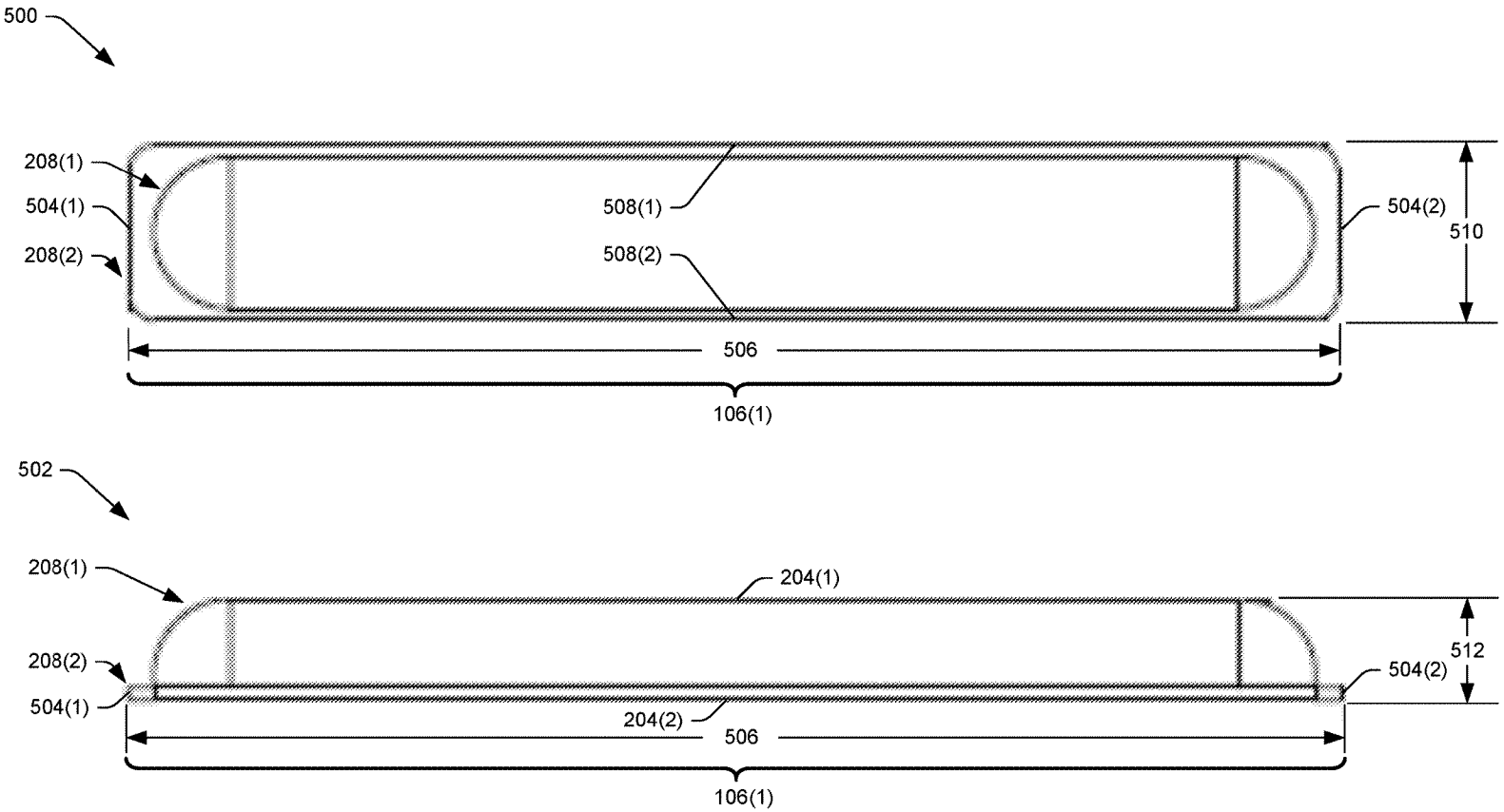
FIG. 5 illustrates a top view and a side view of the example boat fender shown in FIG. 2.

FIG. 5 illustrates a top view 500 and a side view 502 of the example boat fender 106(1) shown in FIG. 2. Top view 500 and side view 502 illustrate the boat fender 106(1) having a first end 504(1), and a second end 504(2) opposite the first end 504(1). Top view 500 and side view 502 illustrate a length 506 of the boat fender 106(1) ranging from about 16 inches to about 34 inches from the first end 504(1) to the second end 504(2). The length 506 of the boat fender 106(1) may be based at least in part on a length of a boat. For example, the boat fender 106(1) may have a length 506 of about 16 inches based at least in part on a boat having a length of about 14 feet. In another example, the boat fender 106(1) may have a length 506 of about 34 inches based at least in part on a boat having a length of about 35 feet. In another example, the length 506 of the boat fender 106(1) may be based at least in part on a width of a boat, a height of a boat, a weight of a boat, etc.

Top view 500 illustrates the boat fender 106(1) having a first side 508(1), and a second side 508(2) opposite the first side 508(1). Top view 500 illustrates the boat fender 106(1) having a width 510 ranging from about 2 inches to about 6 inches from the first side 508(1) to the second side 508(2). The width 510 of the boat fender 106(1) may be based at least in part on a length of a boat. For example, the boat fender 106(1) may have a width 510 of about 2 inches based at least in part on a boat having a length of about 14 feet. In another example, the boat fender 106(1) may have a width 510 of about 6 inches based at least in part on a boat having a length of about 35 feet. In another example, the width 510 of the boat fender 106(1) may be based at least in part on a width of a boat, a height of a boat, a weight of a boat, etc.

Side view 502 illustrates the boat fender 106(1) having a depth 512 ranging from about 1 inch to about 4 inches from the first surface 204(1) of the first elongated shape 208(1) of the first portion 202(1) of the boat fender 106(1) to the second surface 204(2) of the second portion 202(2) of the boat fender 106(1). The depth 512 of the boat fender 106(1) may be based at least in part on a length of a boat. For example, the boat fender 106(1) may have a depth 512 of about 1 inch based at least in part on a boat having a length of about 14 feet. In another example, the boat fender 106(1) may have a depth 512 of about 4 inches based at least in part on a boat having a length of about 35 feet. In another example, the depth 512 of the boat fender 106(1) may be based at least in part on a width of a boat, a height of a boat, a weight of a boat, etc.

While side view 502 illustrates the second surface 204(2) of the second portion 202(2) having a rectilinear surface and/or planar surface, other shapes of the second surface 204(2) are possible. For example, the second surface 204(2) of the second portion 202(2) may have a curved surface, an angled surface, multiple angled surfaces, etc. For example, the second surface 204(2) may have a curved surface, an angled surface, multiple angled surfaces, etc. shaped to fit a shape of a hull (e.g., hull 110) of a boat (e.g., boat 102). For example, the hull of a boat may have one or more angled surfaces and the second surface 204(2) may have substantially the same one or more angled surfaces to fit or mate with the one or more angled surfaces of the hull of the boat to provide for adhering the boat fender 106(1) to the hull of the boat. For example, the boat fender 106(1) may be precontoured to conform to the contours of a hull of a boat. While FIG. 5 illustrates a size of the boat fender 106(1) for use with a boat having a length ranging from about 14 feet to about 35 feet, the boat fender 106(1) may have a size for use with a smaller boat. For example, the size of the boat fender 106(1) may have a size for use with a boat having a length of about 5 feet. For example, the boat fender 106(1) may have a proportionally smaller size for use with personal watercraft (e.g., a jet ski) having a length of about 5 feet.

Figure 6:
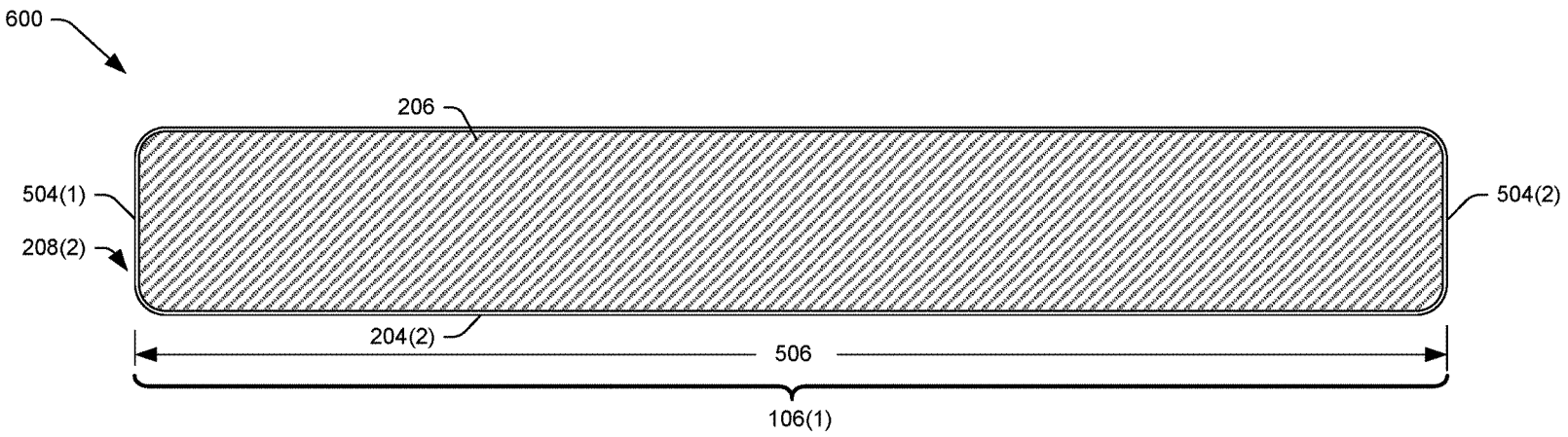
FIG. 6 illustrates an example bottom view of the example boat fender shown in FIG. 2.

FIG. 6 illustrates an example bottom view 600 of the example boat fender 106(1) shown in FIG. 2. The example bottom view 600 illustrates the adhesive 206 arranged on the second surface 204(2) of the second portion 202(2) of the boat fender 106(1). Bottom view 600 illustrates the adhesive 206 may cover about the entire second surface 204(2) of the second portion 202(2) of the boat fender 106(1). While the bottom view 600 shows the adhesive 206 covering about the entire second surface 204(2) of the second portion 202(2) of the boat fender 106(1), the adhesive 206 may cover other amounts of the second surface 202(2). For example, the adhesive 206 may cover substantially the entire second surface 202(2) of the boat fender 106(1). In another example, the adhesive 206 may cover a first portion of the second surface 202(2) proximate to the first end 504(1) of the boat fender 106(1) and/or cover a second portion of the second surface 202(2) proximate to the second end 504(2) of the boat fender 106(1). In another example, the adhesive 206 may cover a middle portion of the second surface 202(2) located about half way along the length 506 of the boat fender 106(1). In another example, the adhesive 206 may be a plurality of elongated strips, circular patches, rectangular patches, etc. of adhesive fixed to the second surface 202(2) and arranged along the length 506 of the boat fender 106(1). While FIG. 6 illustrates the second surface 202(2) being a closed surface, the second surface 202(2) may not be closed. For example, the second surface 202(2) may include one or more pockets, grooves, apertures, etc. arranged in the second surface 202(2). In the example, where the second surface 202(2) includes one or more pockets, grooves, apertures, etc., the adhesive 206 may cover the portions of the second surface 202(2) remaining around the one or more pockets, grooves, apertures, etc.

Figure 7:
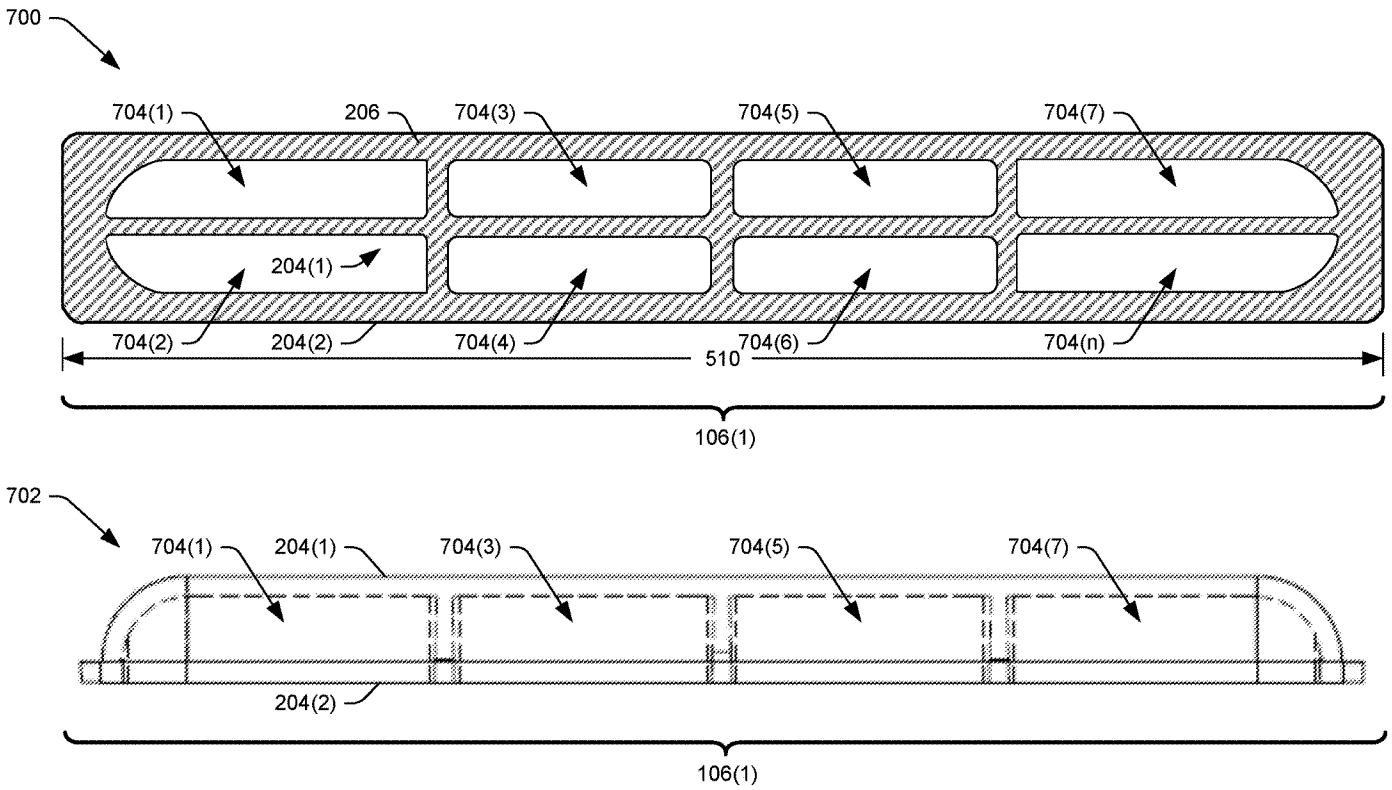
FIG. 7 illustrates another example bottom view and a side view of the example boat fender shown in FIG. 2.

FIG. 7 illustrates another example bottom view 700 and a side view 702 of the example boat fender 106(1) shown in FIG. 2. The example bottom view 700 and the side view 702 illustrate a plurality of cavities 704(1), 704(2), 704(3), 704(4), 704(5), 704(6), 704(7), and **704(*n*) arranged in the second surface 204(2) of the second portion 202(2) of the boat fender 106(1). FIG. 7 illustrates the side view 702 is a transparent side view with hidden lines shown in dashed lines. The plurality of cavities 704(1)-704(*n*) may extend a distance from the second surface 204(2) toward the first surface 204(1). For example, each of the plurality of cavities may extend from the second surface 204(2) into the first portion 202(1) and terminate before penetrating the first surface 204(1) of the first portion 202(1). The example bottom view 700 illustrates the adhesive 206 arranged on the second surface 204(2) around each of the plurality of cavities 704(1)-704**(*n*).

The plurality of cavities 704(1)-704(*n*) may provide for forming the boat fender 106(1). For example, the plurality of cavities 704(1)-704(*n*) may provide for molding the boat fender 106(1). For example, the plurality of cavities 704(1)-704(*n*) may provide for injection molding, hollow injection molding, multi-component injection molding, multi-shot injection molding, etc. the boat fender 106(1). For example, the plurality of cavities 704(1)-704(*n*) may provide for hollow injection molding the boat fender 106(1) using synthetic rubber (e.g., ethylene propylene diene monomer (EPDM) rubber). Each of the plurality of cavities 704(1)-704(*n*) may retain a gaseous substance (e.g., air) when the adhesive 206 is adhered to the portion 108 of the hull 110 the boat 102. The gaseous substance may provide for retaining a shape of the boat fender 106(1). The plurality of cavities 704(1)-704(*n*) retaining the gaseous substance providing for absorbing kinetic energy to prevent damaging the hull 110 of the boat 102.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. A boat fender comprising:

a first portion to absorb kinetic energy to prevent damage to a portion of a hull of a boat, the first portion having:

an elongated shape, the elongated shape having a length longer than a width; and a first surface facing out away from the portion of the hull of the boat, at least a portion of the hull of the boat above a waterline of the boat;

a second portion arranged with the first portion, the second portion having a second surface facing toward the portion of the hull of the boat;

a plurality of cavities arranged in the second surface of the second portion, each cavity of the plurality of cavities extending into the elongated shape of the first portion and each cavity of the plurality of cavities terminating at the first surface of the first portion; and an adhesive arranged on the second surface around each cavity of the plurality of cavities, the adhesive adherable to the portion of the hull of the boat, wherein, when the adhesive is adhered to the portion of the hull of the boat, each cavity of the plurality of cavities retains air, the air retained in each cavity of the plurality of cavities to retain a shape of the boat fender and absorb kinetic energy to prevent damage to the portion of the hull of the boat, and wherein the second portion arranged with the first portion form a single unit molded of synthetic rubber.

2. The boat fender of claim 1, wherein:

the elongated shape of the first portion is a first elongated shape;

the second portion has a second elongated shape, the second elongated shape having a length longer than a width; and the first elongated shape is arranged in-line with the second elongated shape.

3. The boat fender of claim 1, further comprising a length ranging from about 16 inches to about 34 inches.

4. The boat fender of claim 1, further comprising a width ranging from about 2 inches to about 6 inches.

5. The boat fender of claim 1, further comprising:

a depth ranging from about 1 inch to about 4 inches from the first surface of the elongated shape of the first portion to the second surface of the second portion.

6. A boat fender comprising:

a first portion to absorb kinetic energy to prevent damage to a surface of a boat, the first portion having a first surface facing out away from the surface of the boat;

a second portion arranged with the first portion, the second portion having a second surface facing toward the surface of the boat;

a plurality of cavities arranged in the second surface of the second portion, each cavity of the plurality of cavities extending into the elongated shape of the first portion and each cavity of the plurality of cavities terminating at the first surface of the first portion; and an adhesive arranged on the second surface around each cavity of the plurality of cavities, the adhesive adherable to the surface of the boat, wherein, when the adhesive is adhered to the surface of the boat, each cavity of the plurality of cavities retains air, the air retained in each cavity of the plurality of cavities to retain a shape of the boat fender and absorb kinetic energy to prevent damage to the surface of the boat, and wherein the second portion arranged with the first portion form a single unit molded of synthetic rubber.

7. The boat fender of claim 6, wherein the first portion is arranged in-line with the second portion.

8. A boat fender system comprising:

a boat having a surface, the surface for floating the boat; and a boat fender, the boat fender including:

a first portion to absorb kinetic energy to prevent damage to the surface of the boat, the first portion having a first surface facing out away from the surface of the boat;

a second portion arranged with the first portion, the second portion having a second surface facing toward the surface of the boat;

a plurality of cavities arranged in the second surface of the second portion, each cavity of the plurality of cavities extending into the elongated shape of the first portion and each cavity of the plurality of cavities terminating at the first surface of the first portion; and an adhesive arranged on the second surface around each cavity of the plurality of cavities, the adhesive adhered to the surface of the boat, wherein each cavity of the plurality of cavities retains air, the air retained in each cavity of the plurality of cavities to retain a shape of the boat fender and absorb kinetic energy to prevent damage to the surface of the boat, and wherein the second portion arranged with the first portion form a single unit molded of synthetic rubber.

9. The boat fender system of claim 8, wherein the surface for floating the boat is a hull of the boat, or a pontoon of the boat.

10. The boat fender system of claim 8, wherein the first portion has an elongated shape, the elongated shape having a length longer than a width.

11. The boat fender system of claim 8, wherein:

the first portion has a first elongated shape, the first elongated shape having a length longer than a width;

the second portion has a second elongated shape, the second elongated shape having a length longer than a width; and the first elongated shape is arranged in-line with the second elongated shape.

12. The boat fender system of claim 8, wherein at least a portion of the surface of the boat is above a waterline of the boat, and the adhesive is adhered to the portion of the surface of the boat above the waterline to prevent the boat fender from moving on the portion of the surface of the boat above the waterline.

* * * * *